US007797900B2

(12) United States Patent
Sondermann

(10) Patent No.: US 7,797,900 B2
(45) Date of Patent: Sep. 21, 2010

(54) FLOOR PROFILE ARRANGEMENT FOR BRIDGING A JOINT

(75) Inventor: Frank Sondermann, Drolshagen (DE)

(73) Assignee: Herm. Friedr. Künne GmbH & Co., Ludenscheid (DE)

( * ) Notice: Subject to any disclaimer, the term of this patent is extended or adjusted under 35 U.S.C. 154(b) by 869 days.

(21) Appl. No.: 10/576,887

(22) Filed: Feb. 7, 2007

(65) Prior Publication Data

US 2008/0115441 A1 May 22, 2008

(30) Foreign Application Priority Data

Oct. 24, 2003 (DE) ..... 103 49 932

(51) Int. Cl.
*E04F 19/02* (2006.01)

(52) U.S. Cl. ..... 52/466; 52/287.1; 52/396.04; 52/468; 52/461

(58) Field of Classification Search ..... 52/177, 52/204.53, 204.54, 211, 393–395, 296.04, 52/396.1, 402, 459, 461, 464, 466, 468, 716.1, 52/718.01, 718.02, 718.04–718.06, 396.04; 49/467, 468; 16/16
See application file for complete search history.

(56) References Cited

U.S. PATENT DOCUMENTS 2,273,877 A * 2/1942 Kammerer ..... 49/467
3,696,461 A * 10/1972 Kelly ..... 16/16
5,657,598 A * 8/1997 Wilbs et al. ..... 52/393
6,647,680 B2 * 11/2003 Daly et al. ..... 52/396.04
6,745,534 B2 * 6/2004 Kornfalt ..... 52/395
7,409,802 B2 * 8/2008 Fiedler ..... 52/396.04
2002/0095895 A1 7/2002 Daly et al.

FOREIGN PATENT DOCUMENTS

| | | | |
|---|---|---|---|
| AT | 2214 U1 | | 6/1998 |
| DE | 199 51 516 A1 | | 6/2001 |
| DE | 201 17 167 U1 | | 1/2002 |
| DE | 201 18 942 U1 | | 2/2002 |
| DE | 202 14 831 U1 | | 2/2003 |
| EP | 588734 A1 | * | 9/1993 |
| EP | 0 801 187 A1 | | 10/1997 |
| EP | 1 020 590 A2 | | 7/2000 |

* cited by examiner

*Primary Examiner*—Richard E Chilcot, Jr.
*Assistant Examiner*—Matthew J Smith
(74) *Attorney, Agent, or Firm*—Leffert Jay & Polglaze, P.A.

(57) ABSTRACT

A floor profile arrangement is provided, in particular for bridging a joint between adjacent floor coverings, with a base profile, a covering profile with at least one sideways projecting covering wing, and a web arrangement as a connection between the base profile and the covering profile, and with an articulation arrangement, the articulation arrangement consisting of an articular cavity disposed on the base profile or the covering profile and an articulation element formed on the lower or on the upper edge of the pivoting web arrangement.

19 Claims, 13 Drawing Sheets

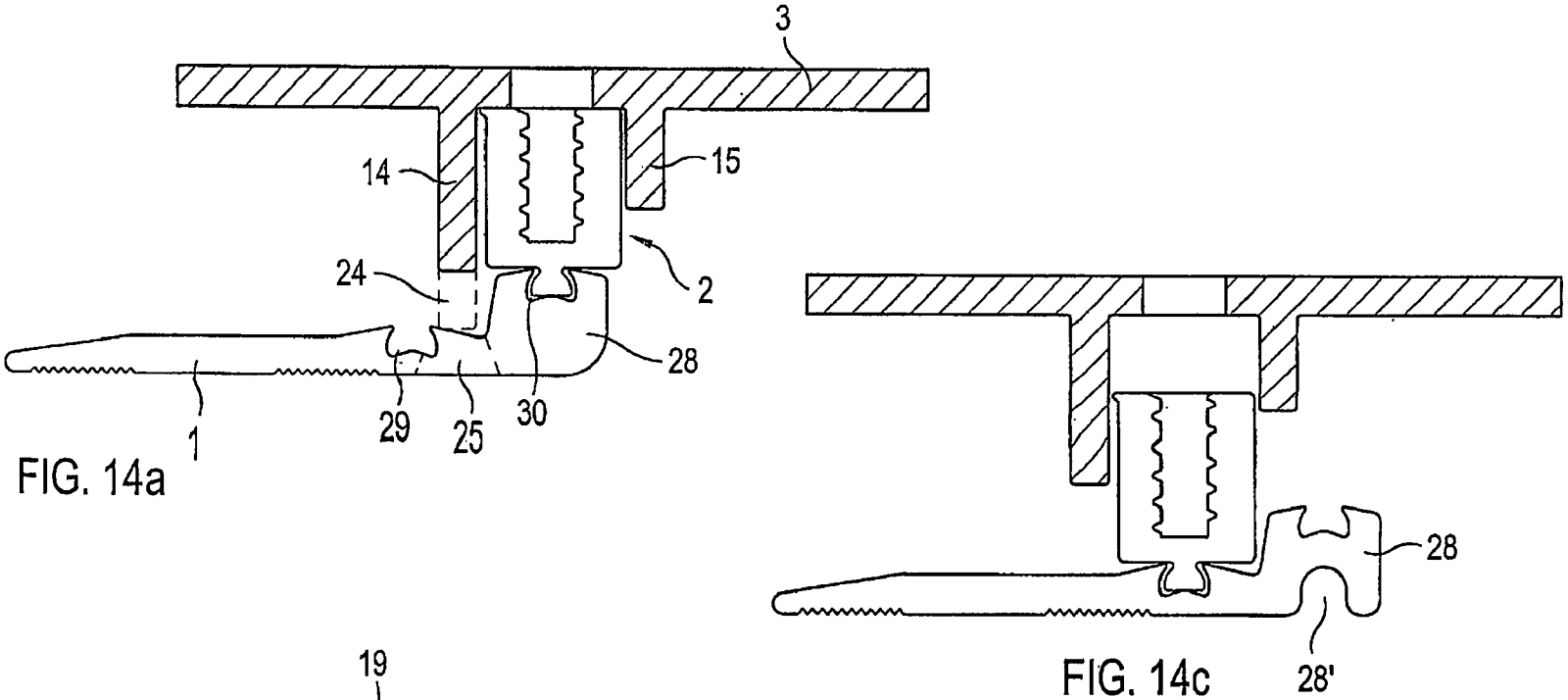
FIG. 14c
FIG. 14a
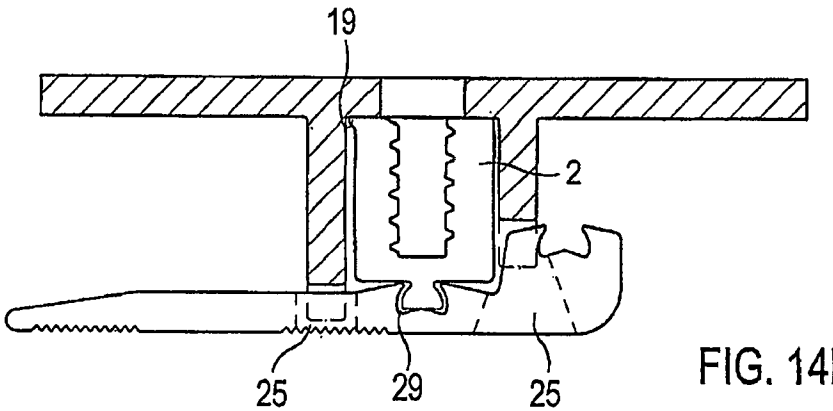
FIG. 14b

FLOOR PROFILE ARRANGEMENT FOR BRIDGING A JOINT

TECHNICAL FIELD OF THE INVENTION

The invention relates to a floor profile arrangement, in particular for bridging a joint between two adjacent floor coverings, according to claims 1 and 2.

BACKGROUND OF THE INVENTION

A joint bridging arrangement for a floor is known from DE 199 51 516 A1 which, for example, makes it possible to bridge a joint in a parquet floor with different heights on either side of the joint. This known joint bridging arrangement consists of a substantially L-shaped base profile, which is screwed onto the floor, and two side pieces extending upwards into the joint. A covering profile with two covering wings projecting sideways is disposed over the joint to be bridged, the covering wings lying over the adjacent floor coverings when in fitted state and being elastically adaptable to different heights of the floor coverings. With the known joint bridging arrangement a web arrangement is provided between the covering profile and the base profile, said web arrangement guiding the covering profile sideways relative to the base profile. For this, on its lower side the web arrangement has two webs extending in the longitudinal direction which encompass the two side pieces of the base profile. On the upper side the web arrangement also has two webs which are encompassed by two webs disposed on the lower side of the covering profile so that sideways movement of the covering profile is guaranteed relative to the base profile despite which it is possible to adjust the height of the covering profile relative to the base profile. The attachment of the covering profile to the base profile can be implemented here by means of screw or snap-on connections.

With this known three-part joint bridging arrangement it is essential to bend one or both covering wings of the covering profile if adapting to a different height of the floor coverings on the two sides. The height differences which can be bridged between the adjacent floor coverings are therefore relatively limited.

SUMMARY

The invention is based upon the objective of improving a joint bridging arrangement of the type specified in the preamble such that greater differences in height between floor coverings adjacent to one another can also be bridged.

The invention includes the general technical teaching of providing a floor profile arrangement with an articulation arrangement such that when bridging a joint between floor coverings with greatly different thicknesses, the covering profile can be inclined towards the thinner floor covering without bending the covering wings of the covering profile to any particularly great degree.

The articulation arrangement here can optionally be provided between the covering profile and a web arrangement and/or between the web arrangement and the base profile. Preferably, the connection between the covering profile and the web arrangement is rigid, and the connection between the web arrangement and the base profile is articulated so that a defined pivot axis is provided.

The articulation arrangement preferably consists of an articular cavity disposed on the base profile or the covering profile and an articulation element disposed on the web arrangement. It is also possible, however, for the articulation arrangement to consist of an articular cavity disposed on the web arrangement and an articulation element disposed on the covering profile or the base profile.

The articulation element can be partially cylindrical in form, for example, and engage in a correspondingly formed, partially hollow-cylindrical articular cavity. It is also possible, however, for the articulated element to be partially spherical and to engage in a partially hollow spherical or partially hollow cylindrical articular cavity. The only crucial factor is that, with regard to its shape and size, the articulated element is adapted to the articular cavity so that a pivoting articulated connection is created.

In the preferred embodiment, the articular cavity is formed between two side pieces of the base profile, and these extend upwardly into the joint. The connection between the articular cavity and the articulation element can be designed to be snap-fastenable and/or releasable so that during fitting the articulated element can be easily pressed into the articular cavity or pushed in sideways. This offers the advantage that the base profile can be fitted on its own, whereas attachment of the web arrangement can only take place subsequently, by means of which fitting is made considerably easier.

It can be advantageous for at least one base surface to be formed on the articulation element and at least one counter surface to be formed on the articular cavity. In this way, easy fitting is achieved because the articulation element is held stably in the articular cavity, but on the other hand pivoting is easily possible if the covering profile is adapted to the different heights of the joint edges to the side.

It can be advantageous for stop surfaces or stop edges to be formed on the longitudinal edges of the side pieces and counter surfaces on an allocated outer surface of the web arrangement. In this way the articulation element is prevented from swivelling out of the articular cavity by mistake.

Moreover, in the preferred embodiment of the invention, height-adjustable sideways movement of the covering profile relative to the web arrangement is provided. For this the covering profile has on its lower side two webs extending into the joint which to the side encompass two webs disposed on the upper side of the web arrangement and extending upwards, the inner distance between the two webs of the covering profile preferably being the same as the outer distance between the webs of the web arrangement so that the covering profile can slide and be height-adjusted relative to the web arrangement. The attachment of the covering profile to the web arrangement can be implemented here, for example, by means of a screw which passes through a hole in the covering profile between the two webs of the covering profile and engages in a threaded channel which is formed between the two webs of the web arrangement.

Alternatively to this, the attachment of the covering profile to the web arrangement can also be achieved by snap-on means which are disposed on the outer sides of the webs of the web arrangement and on the inner sides of the webs of the covering profile and engage with one another respectively in pairs.

It is particularly advantageous if an indentation extending in the longitudinal direction or at least an aperture is disposed on the lower side of the covering profile between the two webs of the covering profile and above the webs of the web arrangement into which, in fitted state, the two webs of the web arrangement can engage so as to extend the height adjustability downwards.

It has already been stated above that the base profile preferably has two side pieces extending upwards into the joint and between which an articular cavity is formed. It is particularly advantageous here if the two webs of the covering profile encompass the two webs of the web arrangement to the side, the width of the articular cavity and the outer distance between the side pieces of the base profile being smaller than or equal to the inner distance between the two webs of the covering profile so that, if so required, the covering profile can be pushed as far downwards as possible.

With an L-shaped design of the base profile it is advantageous if the two downwardly extending webs of the covering profile are of different lengths because otherwise the web of the covering profile lying over the horizontal side piece of the base profile limits the height-adjustability downwards on its own and prematurely. The difference in length of the two webs of the covering profile is therefore preferably the same as the thickness of the horizontal side-piece of the base profile.

The sideways pivot region of the covering profile with respect to the base profile is preferably within the range of +/−20° in relation to a full circle with 360°, but larger or smaller pivot angles are also possible.

A further advantageous embodiment consists of disposing two articulation channels, lying next to one another, on different height levels, one of the channels being formed on a base. It can be beneficial to dispose the higher articulation channel on the edge of the base profile, but other embodiments can also make provision such that the lower articulation channel is formed on the outer side of the base profile and the higher one is disposed on the inner side more towards the middle.

Furthermore, it should be mentioned that the invention is not restricted to the application described above with a joint bridging profile. In fact, the invention can also be used within the framework of a stair edge profile or a corner edge profile.

BRIEF DESCRIPTION OF THE DRAWINGS

FIGS. 14*a*-14*c* show a subsequent example of an embodiment with more than one articulation plane.

DETAILED DESCRIPTION

Figure 1A:
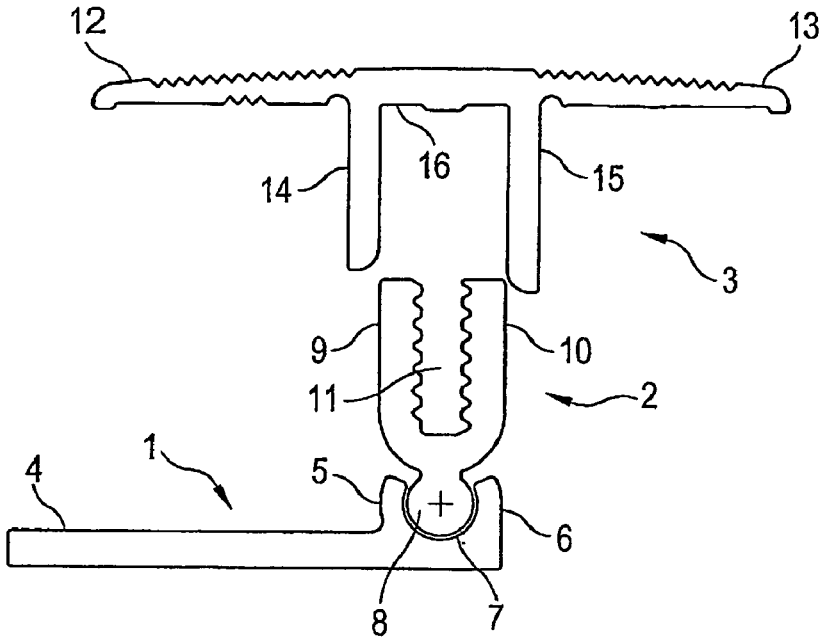
FIGS. 1*a*-1*c* show a three-part pivoting joint bridging profile.
Figure 1B:
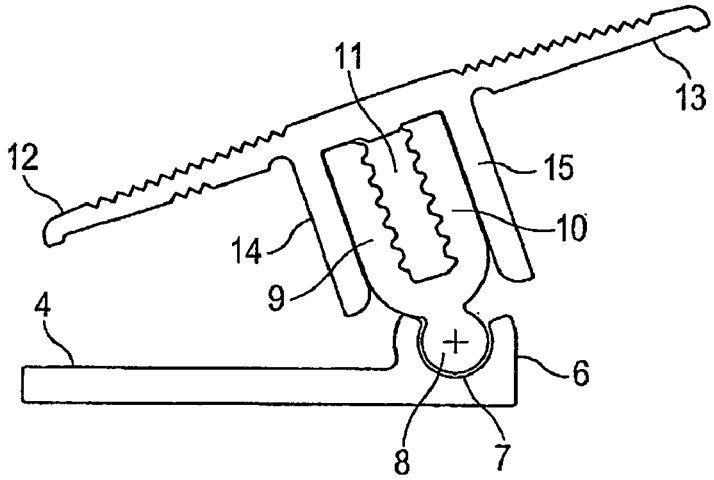
Figure 1C:
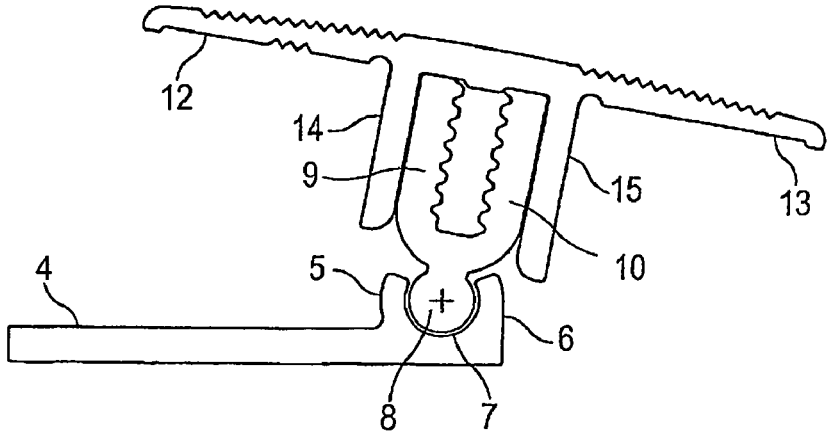

The joint bridging arrangement shown in different fitted states in FIGS. 1*a* to 1*c* is formed in three parts and consists essentially of a base profile 1, a web arrangement 2 and a covering profile 3.

The base profile 1 is essentially designed in an L-shape and has a horizontal side piece 4 which is screwed onto the floor by means of a screw (not shown). Furthermore, the base profile 1 has two side pieces 5, 6 extending upwards into the joint and between which a partially hollow-cylindrical articular cavity 7 is formed into which a partially cylindrical articulation element 8 formed on the lower side of the web arrangement 2 engages so that the web arrangement 2 can pivot relative to the base profile 1.

Furthermore, on its upper side the web arrangement 2 has two upwardly extending parallel side pieces 9, 10, between which a threaded channel 11 for accommodating a screw (not shown) is formed, and which is realised by means of a hole (not shown) in the covering profile 3 in order to screw down the covering profile 3 with the web arrangement 2.

In the conventional manner the covering profile 3 has two covering wings 12, 13 which, in fitted state, lie over the adjacent floor coverings and can be easily bent in order to even out differences in height between the adjacent floor coverings. On their upper side the two covering wings 12, 13 each have a corrugation so as to prevent slipping on the covering profile 3.

On the lower side of the covering profile 3 are disposed two webs 14, 15 which at the side encompass the side pieces 9, 10 of the web arrangement 2 in fitted state and in this way prevent the covering profile 3 from pivoting relative to the web arrangement 2. The inner distance between the two webs 14, 15 of the covering profile 3 is therefore almost the same as the outer distance between the two side pieces 9, 10 of the web arrangement so that the covering profile 3 can be moved sideways with height adjustment relative to the web arrangement 2.

On the lower side of the covering profile 3, between the two webs 14, 15 and above the side pieces 9, 10 of the web arrangement 2, a groove-shaped indentation 16 is disposed which extends the downwards height adjustability of the arrangement.

Furthermore, the two webs 14, 15 of the covering profile 3 are of different lengths. The web 14 of the covering profile 3 is therefore shortened by the thickness of the horizontal side piece 4 of the base profile 1 in order to prevent the web 14 from being placed prematurely on the horizontal side piece 4 of the base profile 1.

In a preferred embodiment, the outer distance between the two side pieces 5, 6 of the base profile 1 can be almost the same as the outer distance between the two side pieces 9, 10 of the web arrangement so that the covering profile 3, disregarding the pivotability, can be pushed down to such an extent that the web 14 of the covering profile 3 lies on the horizontal side piece 4 of the base profile 1, whereas the web 15 of the covering profile 3 lies directly on the floor.

The joint bridging arrangement shown in FIGS. 2*a* to 2*c* largely corresponds to the joint bridging arrangement described above and illustrated in FIGS. 1*a* to 1*c*, so that in the following, the same reference figures are used and reference is largely made to the above description.

Figure 2A:
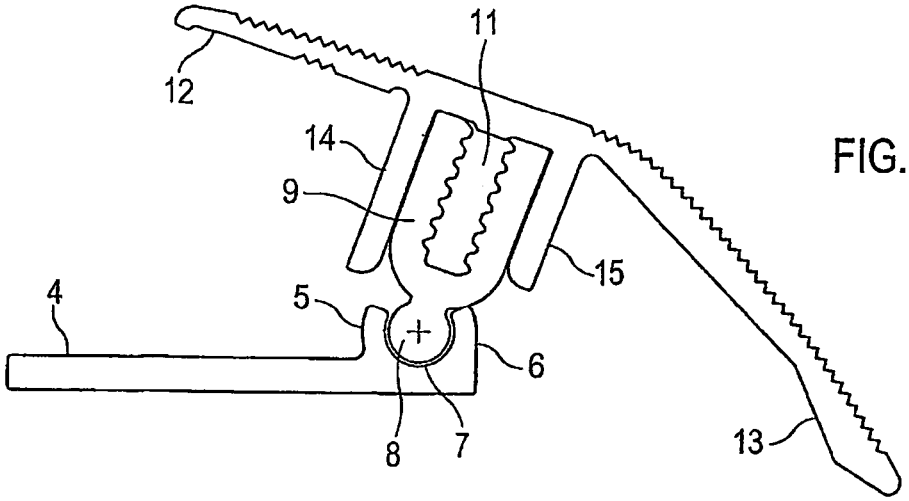
FIGS. 2*a*-2*b* show an alternative example of an embodiment of a three-part, pivoting joint bridging profile.
Figure 2B:
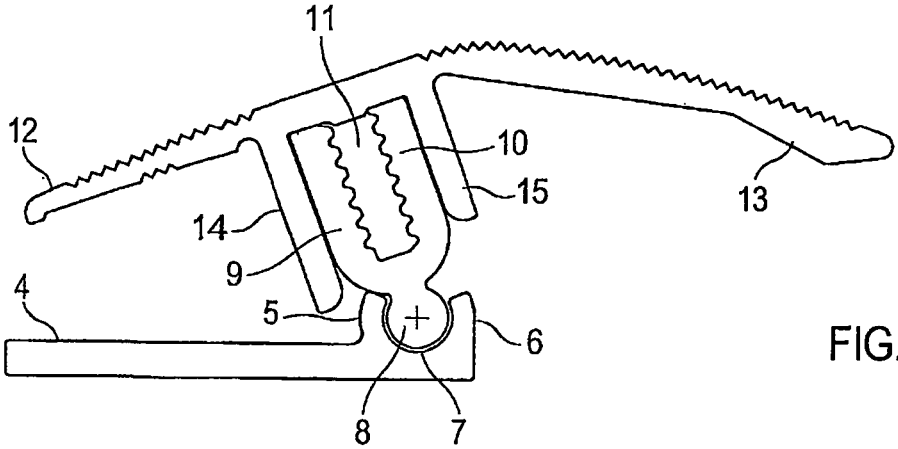
Figure 2C:
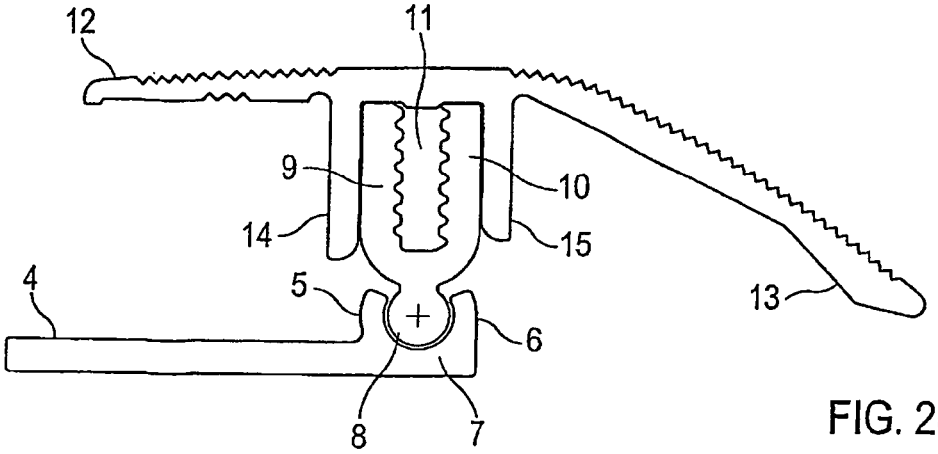

The special feature of the joint bridging arrangement illustrated in FIGS. 2*a*to 2*c* essentially consists of the covering wing 13 of the covering profile 3 already being inclined downwards. This joint bridging arrangement is therefore particularly suitable for bridging joints where a thinner floor covering is used on the right hand side.

The corner edge profile arrangement illustrated in FIGS. 3*a* to 3*c* largely corresponds to the joint bridging arrangement described above and illustrated in FIGS. 1*a* to 1*c*, so that in the following, the same reference figures are used and reference is made to the preceding description.

Figure 3A:
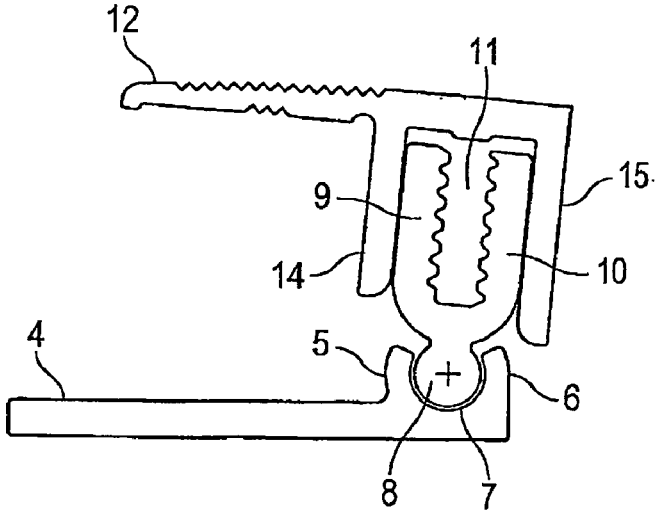
FIGS. 3*a*-3*c* show a three-part pivoting corner edge profile.
Figure 3B:
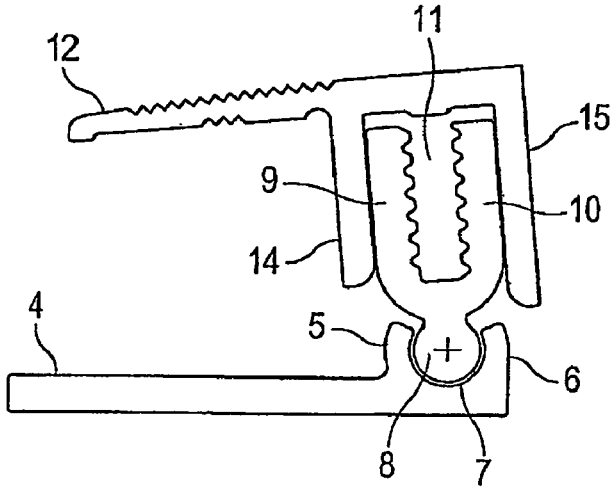
Figure 3C:
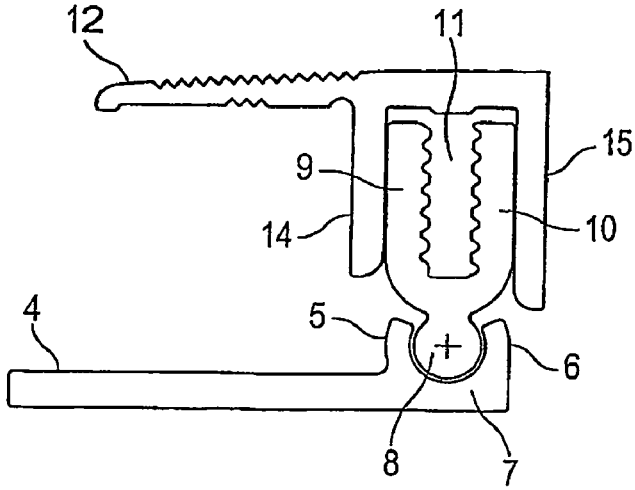

The special feature of the corner edge profile arrangement illustrated in FIGS. 3*a* to 3*c* essentially consists of the covering profile 3 only having a covering wing 12 on one side, whereas on the other side of the covering profile 3 the web 15 forms a limiting surface which for example can lie against a vertical wall of an internal room.

Figure 4A:
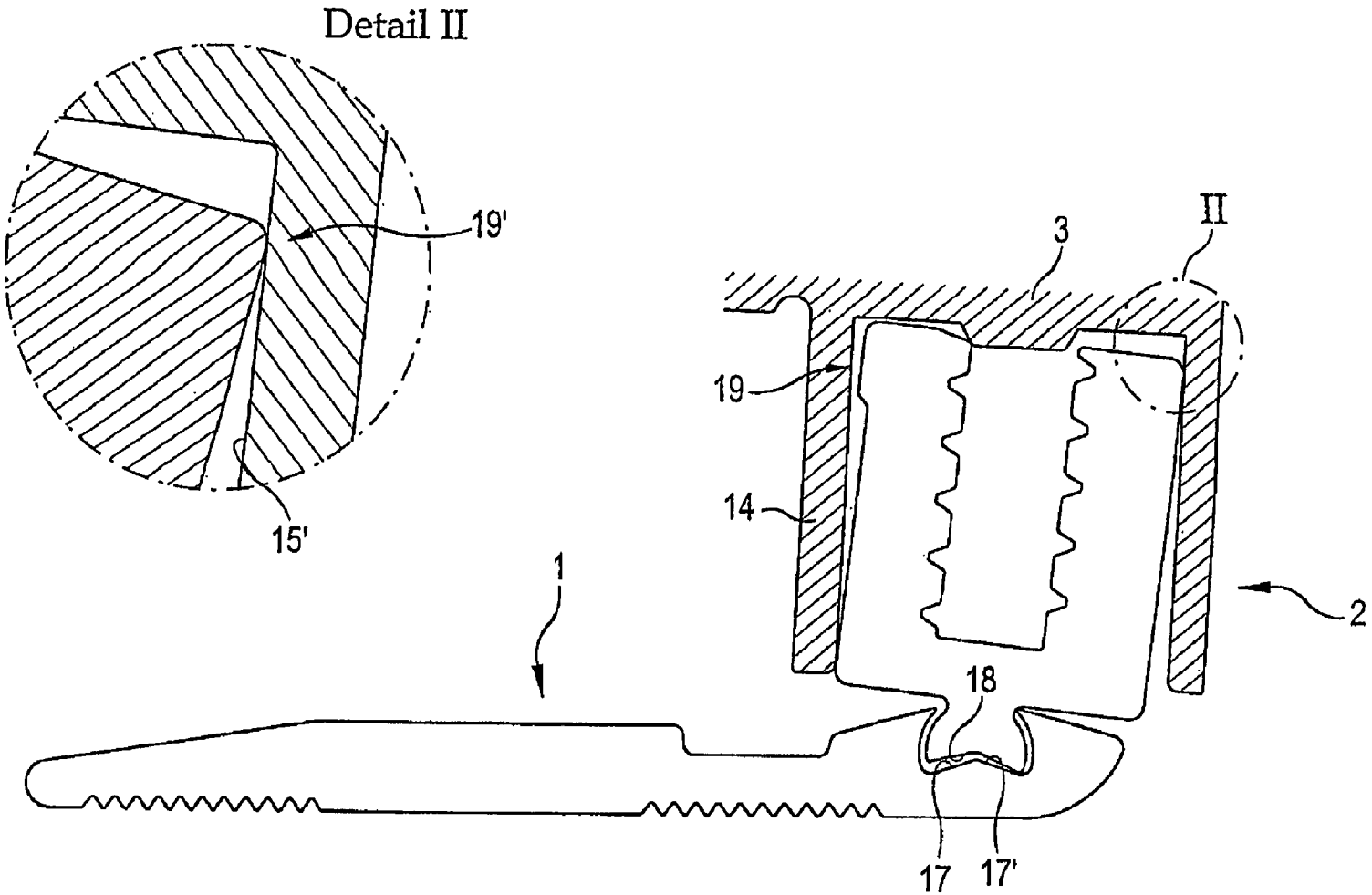
FIGS. 4*a*, 4*b* show a subsequent embodiment variation of the base profile-web arrangement combination.
Figure 4B:
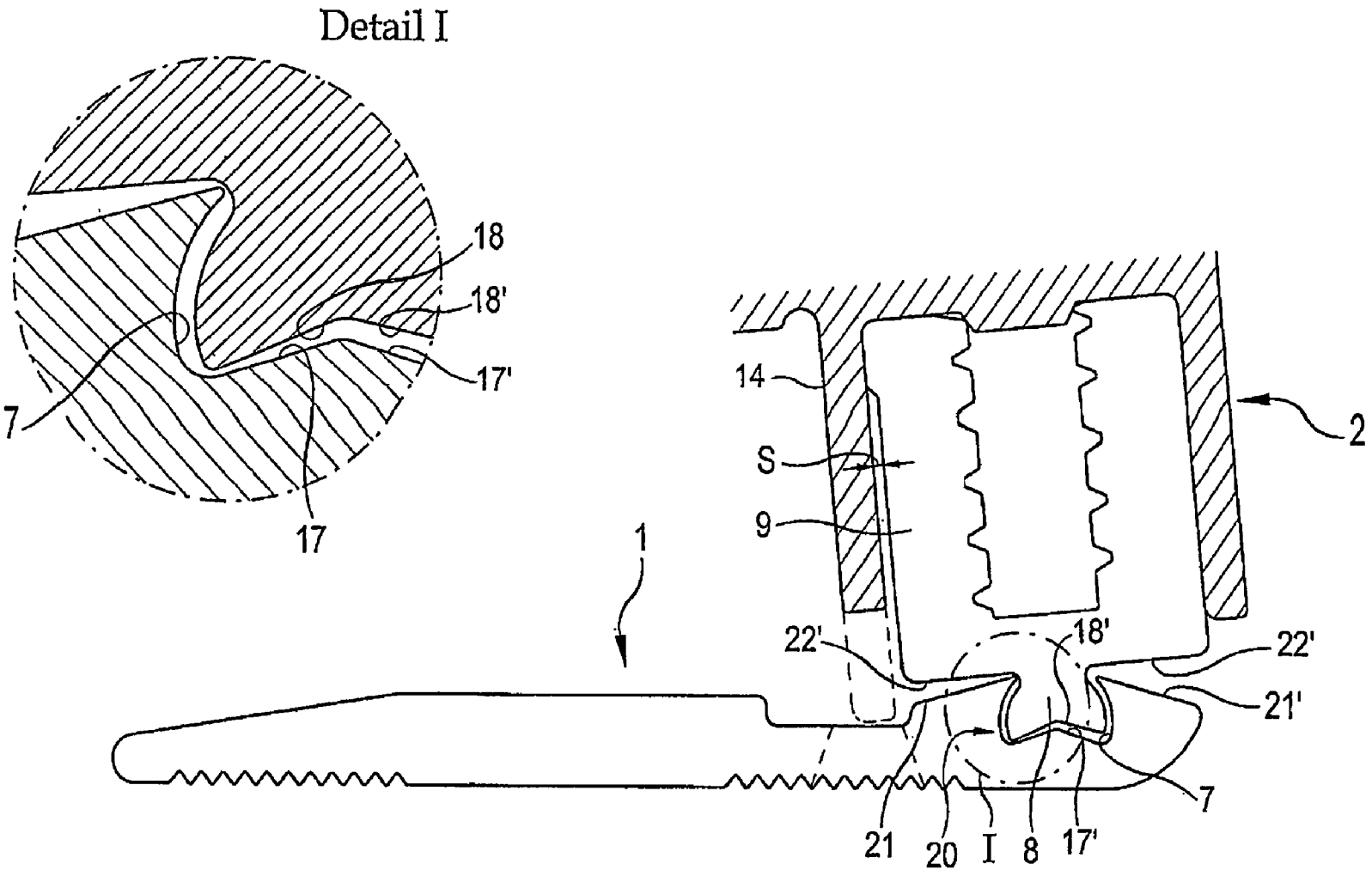

In FIGS. 4*a* and 4*b* a further embodiment of the invention is illustrated. With this embodiment, as shown in enlarged form in Detail I, at least one base surface 18, 18' is formed on the articulation element 8. A corresponding counter surface 17, 17' is formed in the articular cavity 7. By means of this design, when fitted the web arrangement 2 will be given a stable position. On the other hand, for the web arrangement 2 it is of course possible to tilt around the fixed point 20 as the pivot or articulation point. For this, the channel forming the articular cavity and also the articulation element are of a corresponding form. In the example of an embodiment shown, the base surface 18, 18' is essentially in the form of a roof. The ridge of the "roof" lies substantially in the centre of the substantially circular articulation element 8. It is also possible, however, to design the base surface 18, 18' and the corresponding counter surface 17 17' as level surfaces. It is also at the discretion of an expert in the field to set the base and the counter surfaces at a level other than a level through the centre.

In one modification, the angle of the roof of the articular cavity 8 in relation to the angle of the articulation element can be smaller. No stability is achieved by this, but one achieves a good pivot capability of the web arrangement.

With the embodiment illustrated, the lower circumferential surfaces on the web arrangement are substantially level in form. The extent of the tilting movement is limited by the stop surfaces 21 and 22 on the respective surfaces of the base profile or of the web arrangement pointing downwards and pointing upwards, the stop surfaces being formed at least partially by the lower level circumferential surfaces.

In FIG. 4*a* in the upper region of the free side pieces 9, 10, a tilting projection 19 is formed on the web arrangement 2. FIG. 4*b* schematically illustrates the gap S which forms between the mutually opposite walls of the side pieces 9 and 14 of the allocated components due to the tilting projection 19 when the covering profile 3 is placed normally on the web arrangement 2. This tilting projection 19 makes it possible for the covering profile 3 to tilt inwards by a specific angle. The tilting movement happens until the side piece 14 of the covering profile 3 strikes the lower region of the web arrangement 2 after having passed through the gap S. At the same time the edge 19' of the web arrangement 2 located in the top left of the drawing strikes the inner wall 15' of the web 15 (see. Detail II). Because of this the two components tilt and remain in this position by means of the screw fixing.

Figure 5:
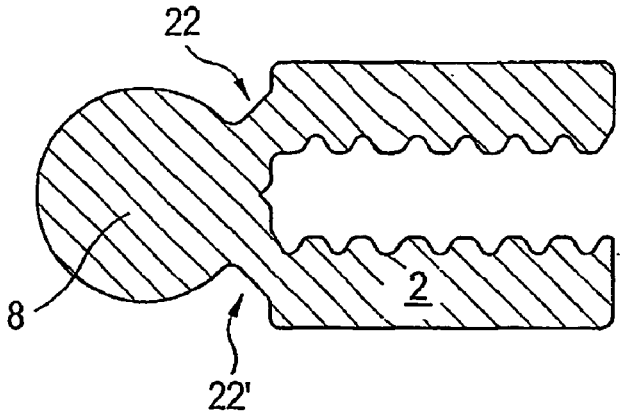
FIG. 5 shows a view of the cross-section profile of an embodiment of the web arrangement.
Figure 6:
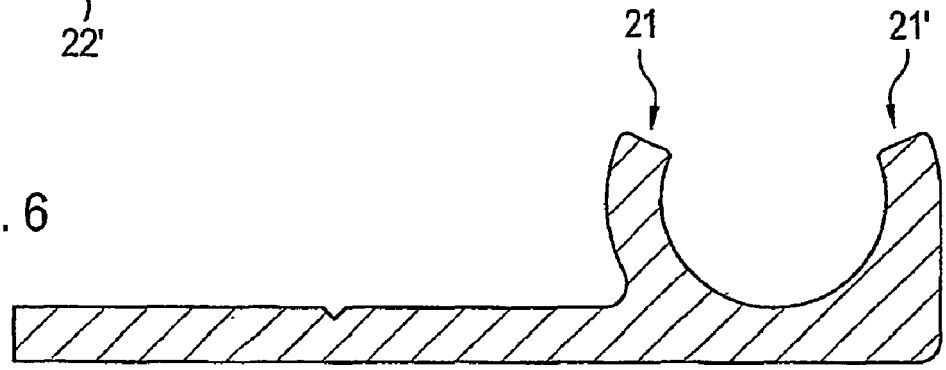
FIG. 6 shows a view of the cross-section of a base profile with an articular cavity.

In FIG. 5 to FIG. 7 a cross sectional view through the base profile 1 and the web arrangement 2 are shown. Between the web arrangement 2 and the base profile 3 stops are formed, the effect of which is to limit the tilting movement of the web arrangement. The stops are formed by stop surfaces 22, 22', the web arrangement and stop surfaces 21, 21' which are disposed on the free end edges of the side pieces 5, 6 of the base profile (FIG. 6). The angular position of the stop surfaces in relation to the centre point of the articulation element thus determines the extent of the pivot movement.

Figure 7A:
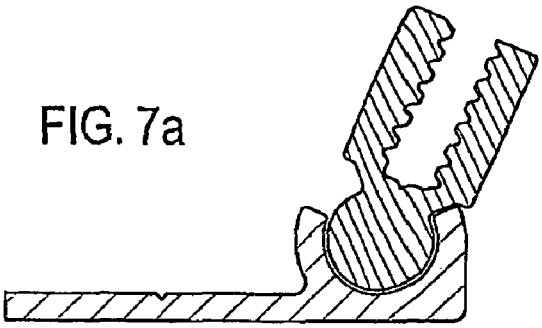
FIGS. 7*a*-7*c* show a view of the assembled elements from FIG. 5 and FIG. 6 in the cross-section in different pivot positions.
Figure 7B:
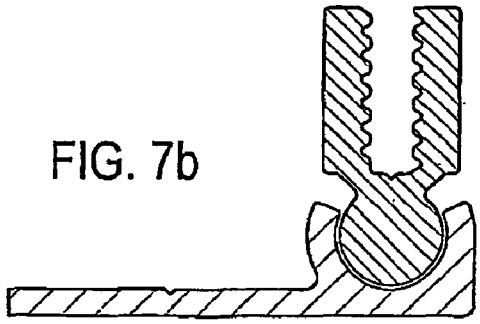
Figure 7C:
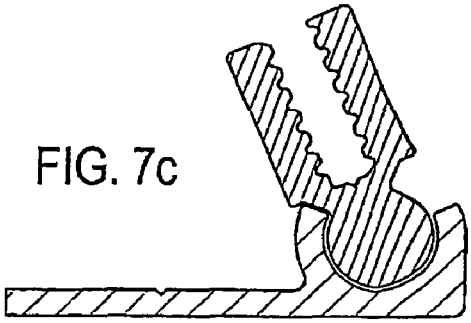

FIGS. 7*a* to 7*c* schematically show the angular positions which can be adopted as the right side (FIG. 7*a*) and left side (FIG. 7*c*) extreme positions of the web arrangement 2. FIG. 7*b* shows the web arrangement 2 in the normal upright position. The dimensions of the articular cavity and the articulation element can be designed such that a light clamp-fit is achieved so that the web arrangement 2 has a predetermined inertia in relation to the position set, and in this way the covering profile 3 can be easily fitted without worrying about the web arrangement 2 coming away before a screw can be inserted.

Figure 8A:
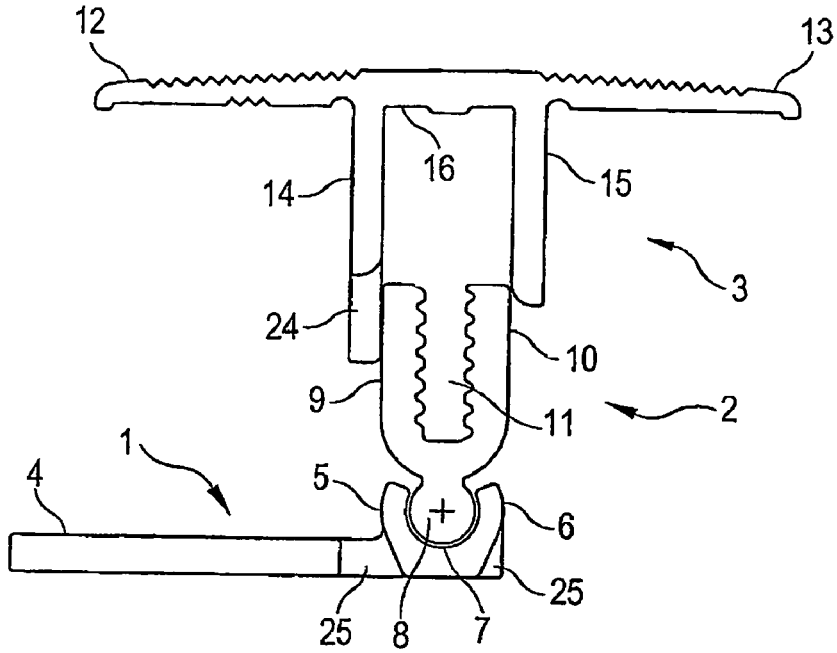
FIGS. 8*a*-8*c* show a three-part joint bridging profile according to the embodiment according to FIGS. 1*a*-1*c* with elongated webs of the covering profile and recesses in the base profile.
Figure 8B:
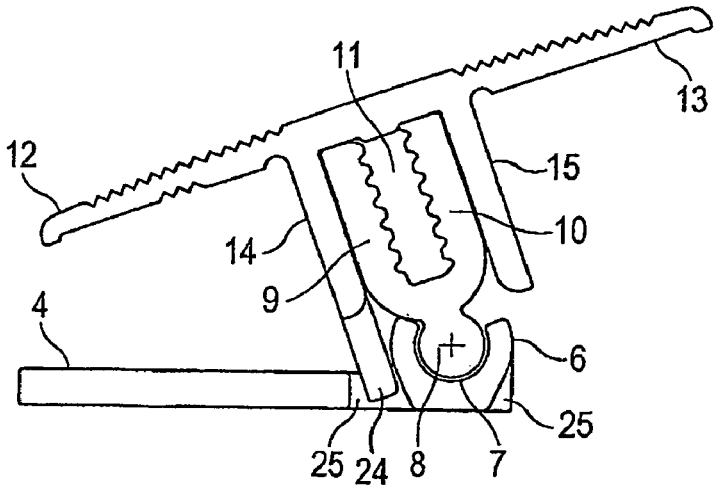
Figure 8C:
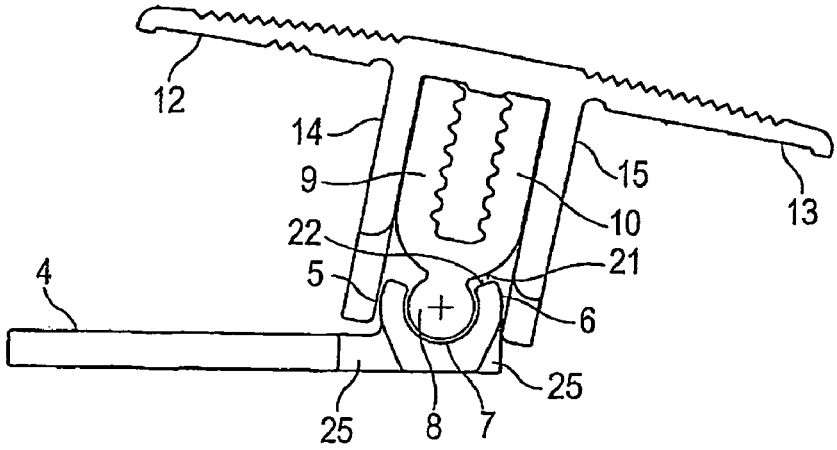

In FIGS. 8*a* to 8*c* a subsequent example of an embodiment of a floor profile arrangement according to the invention is illustrated. With this embodiment, elongations 24 are formed on the webs 14, 15 of the covering profile and which are preferably formed at regular distances along the lower edge of one or both of the webs 14, 15.

At corresponding points on the base profile 4 recesses 25 are provided into which the elongations 24 can be inserted. FIG. 8*a* shows an assembly situation whereby the covering profile 3 is placed onto the web arrangement 2. The web arrangement 2 extends substantially vertically upwards here.

FIG. 8*b* shows the covering profile in the attached state, positioned at an angle and in the deepest position. The elongation 24 here is inserted into the recess 25. One can see that the recess 25 is sufficiently wide so as to accommodate the elongation, even in the inclined state.

FIG. 8*c* shows the floor profile in the opposite inclined position. One can see that the right-hand web, which in this illustration is also provided with an elongation 24, can be inserted into the corresponding recess 25 if the covering profile is inclined even further to the right, until the web arrangement 2 strikes with its stop surface 21 against the counter surface 22 on the side piece 6 of the base profile.

Figure 9:
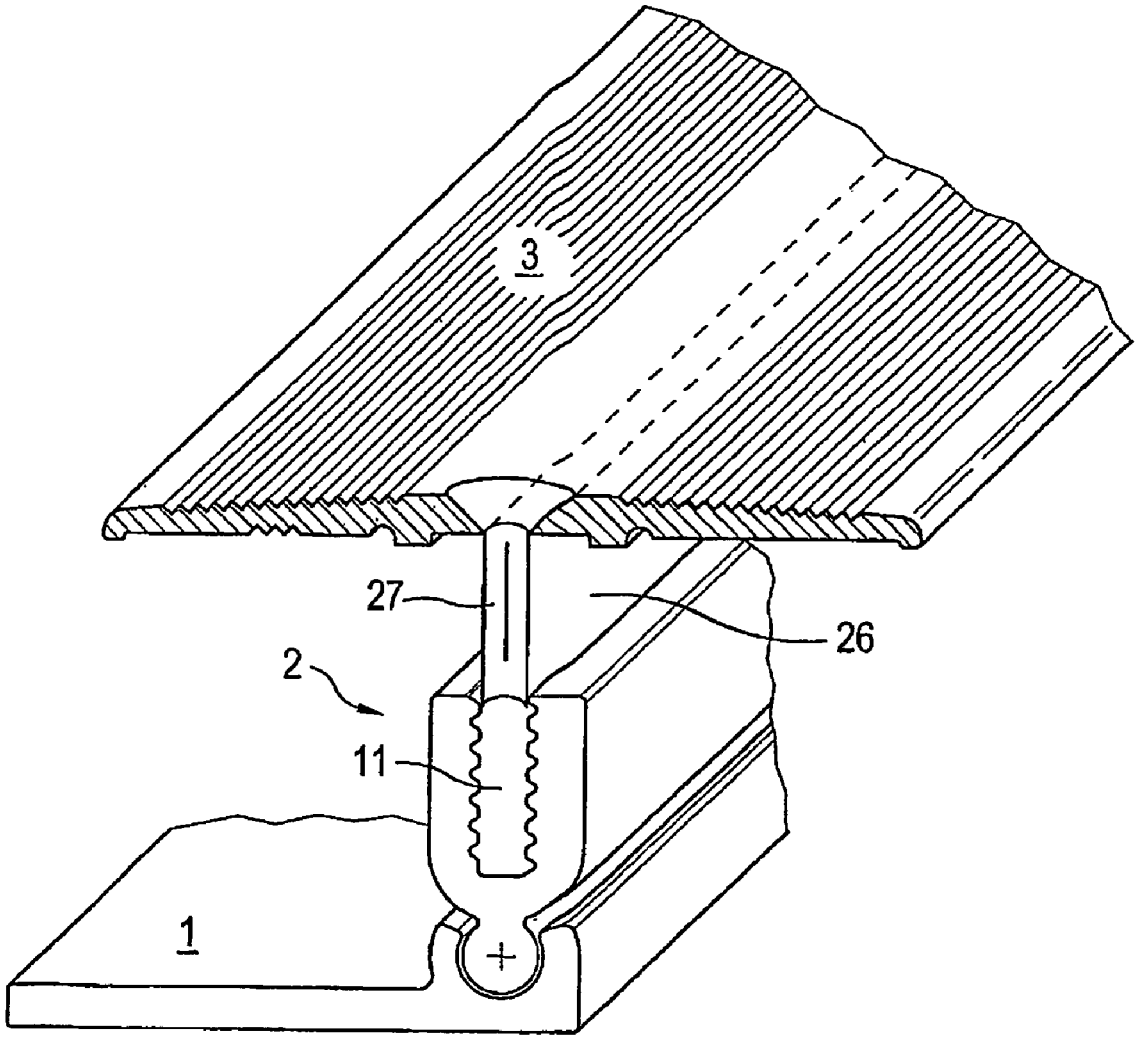
FIG. 9 shows a subsequent example of an embodiment of the invention with a single web on the covering profile.

FIG. 9 shows a subsequent example of an embodiment with which a single web 26 is disposed on the covering profile 3. The single web 26 is non-continuous in the region of the screw holes so that a screw channel 27 is formed. The screw channel 27 is of proportions such that a screw can be driven through it with play. The single web 26 can be inserted into the threaded channel 11 by sliding.

FIG. 10 shows a further development of the embodiment according to FIG. 9. With this embodiment, elongations 24 are formed on the lower edge of the single web 26. These elongations 24 make possible a greater insertion height, i.e. the maximum distance between the base profile 1 and the covering profile 3 can be increased. The elongations 24 can be formed at regular, predetermined intervals along the single web 26, a preferred embodiment here possibly consisting of the elongation 24 bridging the screw channel 27 in the downwards direction. In this way, particularly high stability of the covering profile 3 is achieved.

On its lower edge the web arrangement has recesses 25' which make it possible for the elongation 24 to pass through the web arrangement 2 and out of the web arrangement 2 at the bottom. The base profile 1 is provided with recesses 25 below the web arrangement 2, and the width of these recesses 25 is sufficient in order to accommodate the projection 24. The length of the recess 25 in the base profile 1 extends over a predetermined length LB. The length LB is made up of the length LV of the projection 24 in the longitudinal direction and the extent of the longitudinal extension LG of the articulation element 8 on the web arrangement 2. The measurement LB is therefore also the measurement for the distance of the projections 24 on the single web 26 along the covering profile 3. By means of this type of arrangement it is possible to insert the web 26 with the projections 24 into the channel 11, and to place this pre-assembled unit onto the base profile 1 such that the projection 4 and the articulation element region located next to the projection 24 fits into the recess 25 with the measurement LG. The covering profile can then be pushed to the right so that the articulation element 8 is introduced from the side into the articular cavity 7. The depth of the projection 24 can be chosen such that it passes through the recess 25 until the lower edge 24' of the projection 24 is flush with the lower edge 25' of the recess 25 in the base profile 1. The sideways movement is then limited to the measurement LG because the projection 24 strikes against the face edge 7' below the articular cavity 7.

Figure 10A:
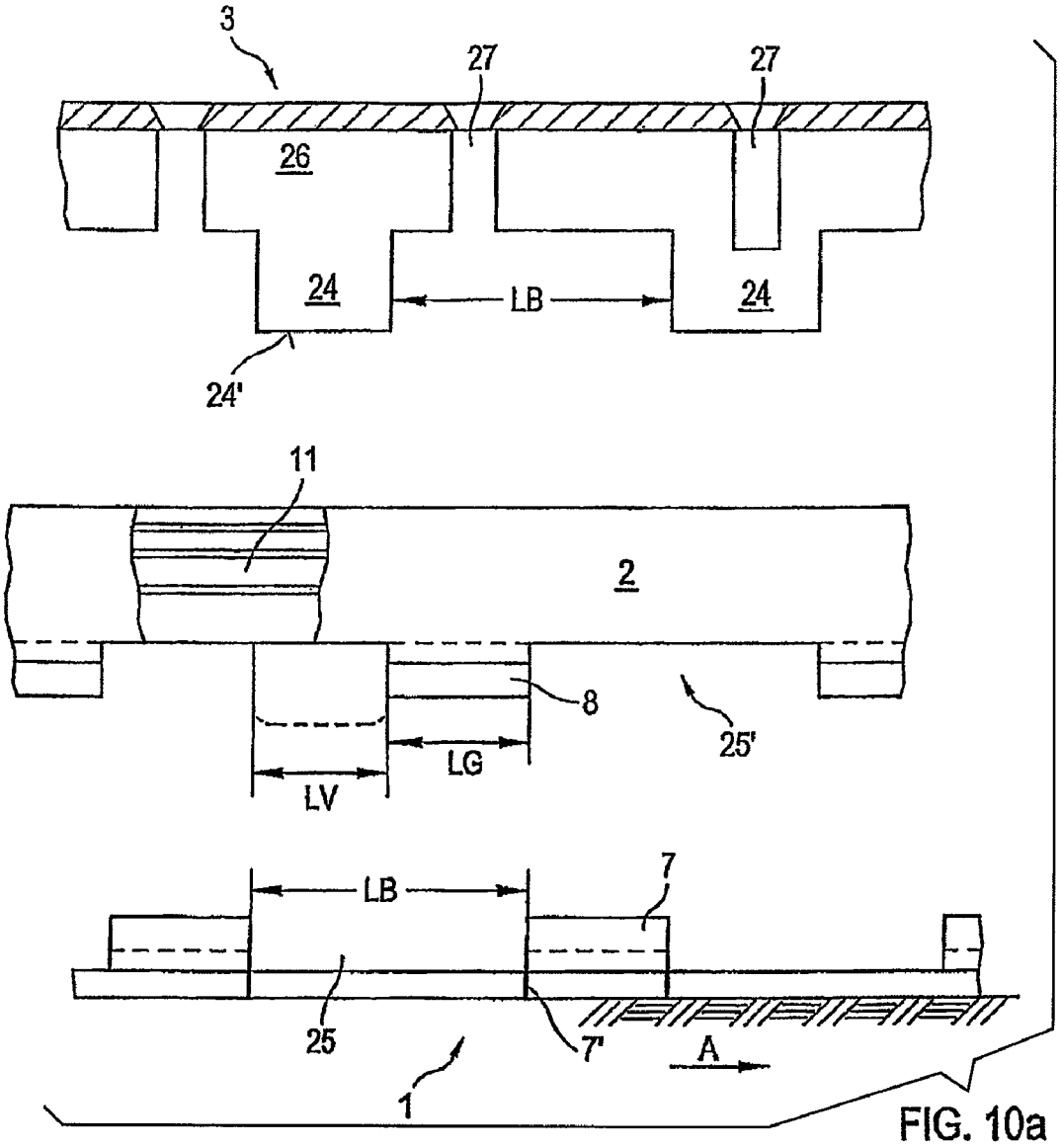
FIGS. 10*a*-10*b* show a further example of an embodiment with a single web with short elongations formed on the web arrangement.
Figure 10B:
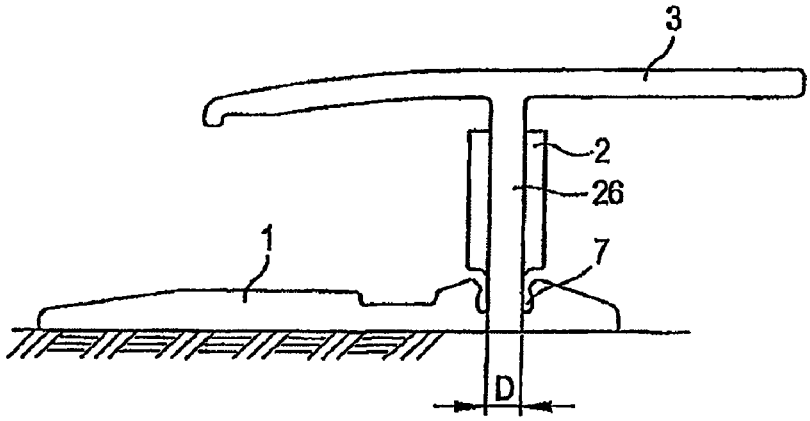
Figure 11A:
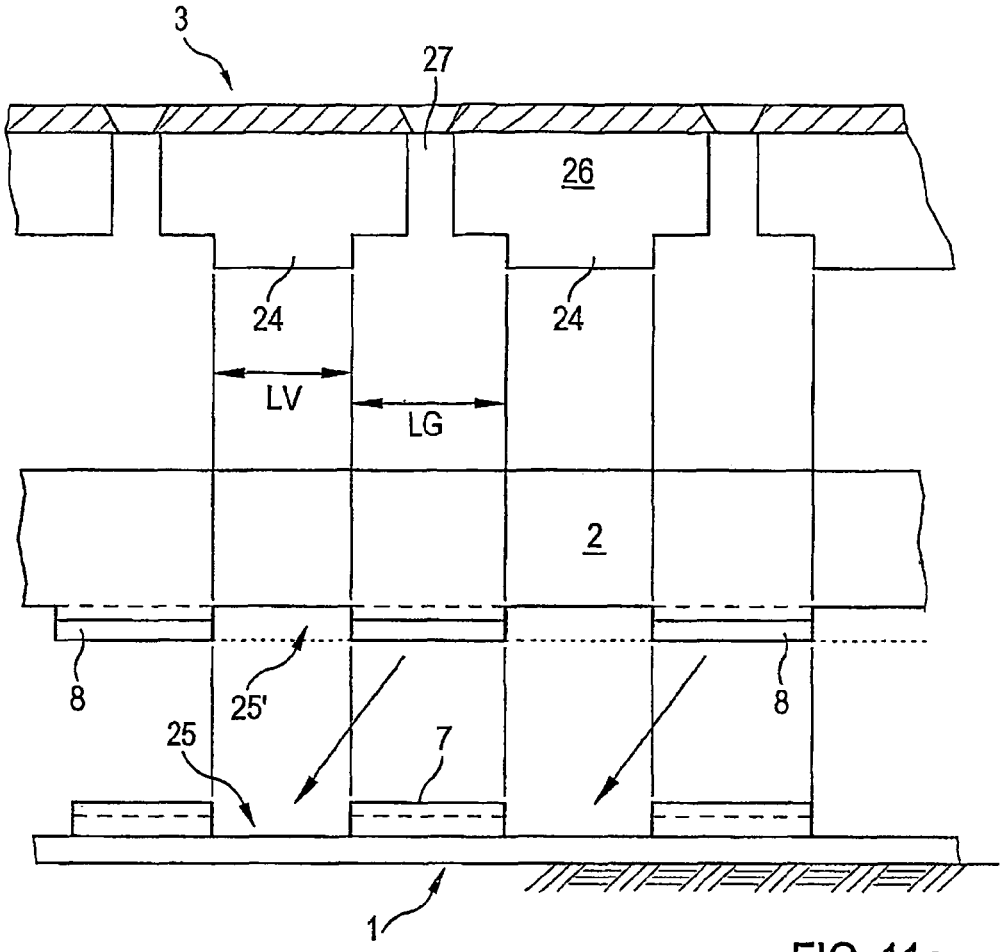
FIGS. 11*a*-11*b* show a further example of an embodiment with a single web with enlarged elongations formed on the web arrangement.
Figure 11B:
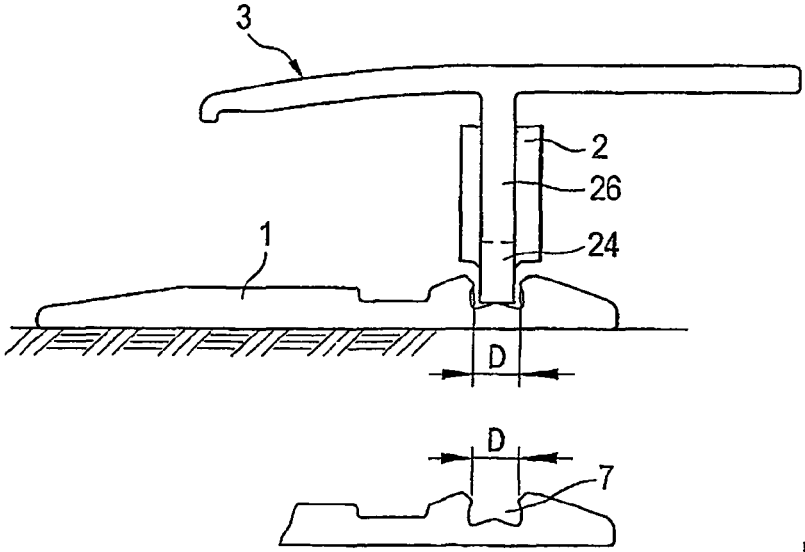

FIG. 10*a* shows the components of the base profile 1, the web arrangement 2 and the covering profile 3 in an exploded view in a position in which the individual components can be fitted together so as then, following insertion, to be pushed in the direction of the arrow A. FIG. 10*b* is a schematic illustration of a cross-section of the assembled profile. One can see that the web 26 is positioned flush against the lower edge of the base profile. With this embodiment it is not necessary for the thickness of the web 26 and the clearance of the upper insertion point of the articular cavity 7 to have a predetermined relationship to one another. However the example of an embodiment illustrated in FIG. 11, which is a modification of the embodiment illustrated in FIG. 10, is designed such that the web 26 can be inserted with its elongation 24 into the articular cavity 7 which is open to the top, and can be pushed to the left or to the right, as required. The recess 25' in the web arrangement 2, i.e. the point at which the articulation element 8 has been removed and so a free passage of the projection 24 is made possible, only has the length LV. The web arrangement is correspondingly provided with sections of length LG in which the articulation element 8 is formed. On the base profile, cut-outs or recesses 25 are formed in the articular cavity region 7 into which the sections LG of the web arrangement 2 can be inserted. Because the thickness of the web 26, and so also the thickness of the projection 24, is smaller than the clearance of the opening D of the articular cavity 7, the projection 24 passes into the articular cavity. If the web arrangement is positioned in the manner described, it can be pushed to the left or to the right, as required.

Figure 12A:
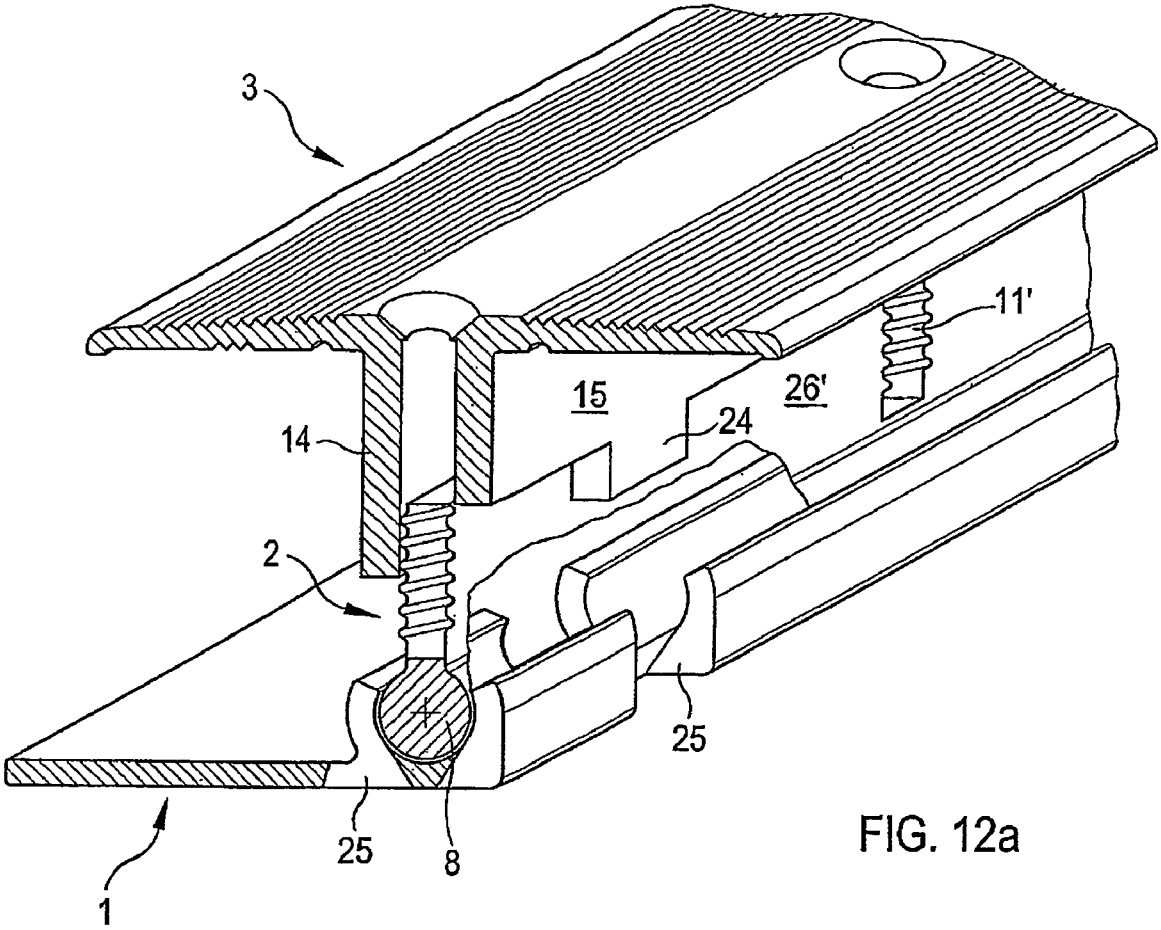
FIG. 12 shows a further example of an embodiment with a single web formed on the web arrangement and a single web on the web arrangement.
Figure 12B:
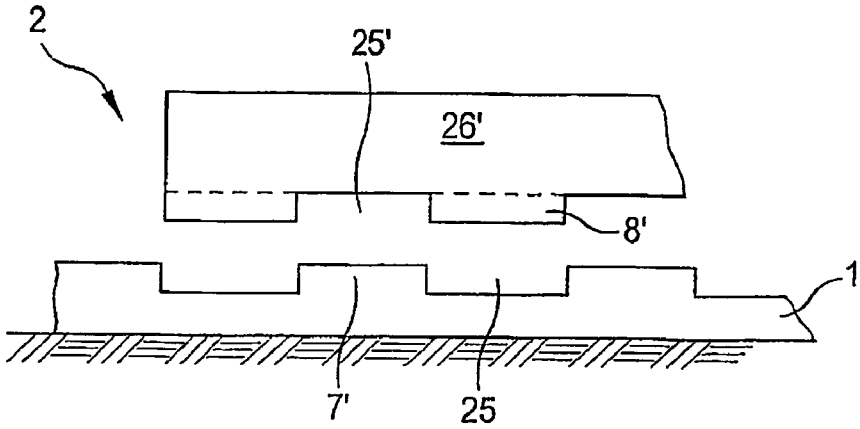

In FIG. 12, a subsequent embodiment of a floor profile arrangement is illustrated with which the central portion consists of a single web 26' on the lower edge of which the articulation element 8 is formed. The web 26' has threaded holes or threaded channels 11' regular distances apart into which the attachment screws (not shown) can be screwed. The structure of the covering profile 3 essentially corresponds to the covering profile according to the example of an embodiment FIG. 1, but the distance between the webs 14 and 15 is adapted to the thickness of the individual web 26. The threaded hole or the threaded channel 11' extends by a predetermined amount into the web.

With this embodiment, elongations 24 can also be formed on the side pieces 14 and 15. These extend into corresponding recesses 25, on which the region of the articular cavity has been removed.

In order to make it easy to insert the central portion 2, the articulation element 8 is removed below the web 26 in predetermined regions by recesses 25' so that articulation element regions 8' remain. With the recesses 25, these articulation element regions 8' can be placed on the base profile and be pushed sideways into the articular cavity region 7'. With this embodiment, following insertion of the web arrangement 2 into the base profile 1, the covering profile can not be pushed sideways together with the web arrangement 2 if it is provided with the elongations 24. In order to make simple installation possible, provision can be made such that a plurality of holes or channels 11' are provided in the single web which are in a predetermined dimensional relationship to the elongations 24.

Figure 13:
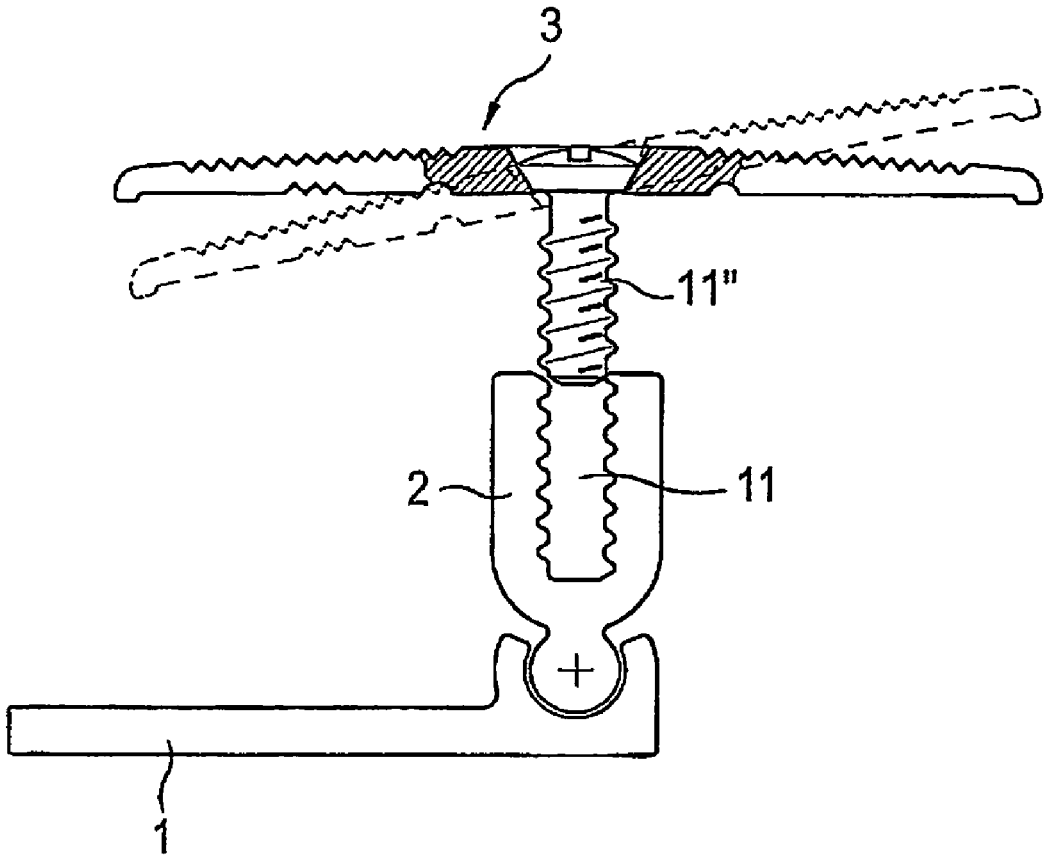
FIG. 13 shows a further example of an embodiment with a covering profile without a web.

FIG. 13 shows a particularly simple embodiment of a floor profile arrangement. Here, webs 14 and 15 were dispensed with. Only screws 11" were screwed into the channel 11 of the web arrangement 2. In order to achieve the desired stability, with this embodiment of the floor profile arrangement a greater number of screws are used per unit of length than is necessary with the previously described examples of embodiments.

In FIGS. 14*a*-14*c* a subsequent example of an embodiment of a floor profile arrangement according to the invention is illustrated. With this embodiment, the base profile has two articular cavity channels 29 and 30 disposed next to one another on different height levels. In FIG. 14*a* the web arrangement 2 is located in the upper articular cavity channel 30 which is formed on a base 28. For reasons relating to economy of materials, the base 28 can be in the form of a bridging arch which results in materials being saved in the region 28'. FIG. 14*b* shows the arrangement with which the web arrangement 2 is disposed in the lower articular cavity channel 29. It is self-evident that with this embodiment too, elongations 24 can be formed on the webs 14 and 15 which can correspondingly be inserted in recesses 25 which are formed in the base profile 1. It is also self-evident that with this example of an embodiment, the base profile and the web arrangement can be designed such that they can be assembled by simply positioning and pushing to the side. Also with this example of an embodiment, a tilting projection 19 can be provided which makes possible a tilt angle between the covering profile 3 and the web arrangement 2.

The invention is not restricted to the preferred examples of embodiments disclosed above. Indeed, a large number of variations, modifications and combinations of individual details described in different embodiments are conceivable which also make use of the idea behind the invention and so fall within the scope of protection.

The invention clamed is:

1. A floor profile arrangement, in particular for bridging a joint between two adjacent floor coverings, comprising a base profile, a covering profile with at least one sideways projecting covering wing, and a web arrangement as a connection between the base profile and the covering profile, and with an articulation arrangement, the articulation arrangement consisting of an articular cavity disposed on the base profile or the covering profile and an articulation element formed on the lower or on the upper edge of the pivoting web arrangement, wherein at least one of two downwardly extending webs of the web arrangement of the covering profile has elongations spaced apart from one another to which recesses formed in the base profile are allocated, whereas a difference in length is provided between the two webs of the covering profile that substantially corresponds to the thickness of a horizontal side piece of the base profile.

2. The floor profile arrangement according to claim 1, wherein the articulation element is at least partially cylindrical, and the articular cavity is at least partially hollow-cylindrical.

3. The floor profile arrangement according to claim 1, wherein the articulation element is at least partially spherical, and the articular cavity is at least partially hollow-spherical or partially hollow-cylindrical and the connection between the articular cavity and the articulation element is releasable.

4. The floor profile arrangement according to claim 1, wherein the base profile has two upwardly extending side pieces between which the articular cavity is formed.

5. The floor profile arrangement according to claim 1, wherein at least one base surface is formed on the articulation element, and at least one counter surface is formed on the articular cavity and the base surfaces in the articular cavity are formed like a pitched roof, and the counter surfaces on the articulation element are formed correspondingly.

6. The floor profile arrangement according to claim 1, wherein stop surfaces are formed to the side of each of the side pieces and counter surfaces are formed on the web arrangement and the stop surfaces are formed respectively on the longitudinal edges of the side pieces, and counter surfaces are formed on an allocated outer surface of the web arrangement.

7. The floor profile arrangement according to claim 1, wherein the web arrangement has two webs running parallel, forming a channel between them, and the covering profile also has two webs which each encompass the webs from the outside.

8. The floor profile arrangement according to claim 7, wherein the channel between the two side pieces of the web arrangement is formed, at least in sections, as a threaded channel for a screw, and at least one hole is disposed in the covering profile through which the screw can pass.

9. The floor profile arrangement according to claim 1, wherein the web arrangement has two webs running parallel, forming a channel between them, and the covering profile has a web which can be inserted into the channel and the webs of the covering profile and the side pieces of the central profile fit closely together.

10. The floor profile arrangement according to claim 9, wherein the covering profile is provided with a plurality of holes by means of which the covering profile can be screwed into the threaded channel by means of the screws.

11. The floor profile arrangement according to claim 9, wherein the clearance D of the articular cavity in the base profile is of a width greater than the inner distance between the two webs of the web arrangement.

12. The floor profile arrangement according to claim 1, wherein the web arrangement has a web, and the covering profile has two parallel webs a distance apart from one another which encompass the web from the outside.

13. The floor profile arrangement according to claim 7, wherein the webs of the covering profile and the webs of the web arrangement have snap-on means for mutual snap-fastening.

14. The floor profile arrangement according to claim 7, wherein on the lower side of the covering profile above the side pieces of the central profile a groove-shaped indentation extending in the longitudinal direction, or at least an aperture/recess is formed.

15. The floor profile arrangement according to claim 1, wherein the base profile is substantially L-shaped and has a substantially horizontal side piece and a substantially vertical side piece, whereas the covering profile with respect to the base profile has a side pivot region of +/−20 degrees in relation to a full circle with 360 degrees.

16. The floor profile arrangement according to claim 15, wherein on at least one of the side walls of the web arrangement allocated to one another on the one hand, and the webs of the covering profile on the other hand, a tilting projection is formed.

17. The floor profile arrangement according to claim 1, wherein on the web arrangement and on the base profile, in the region of the articulation arrangement, are formed in sections recesses the dimensions of which are chosen such that a section LG of an upper articulation element can be inserted into the recess between two sections of the lower articulation element.

18. The floor profile arrangement according to claim 1, wherein by a design in the form of a joint bridging profile, a stair edge profile or a corner edge profile.

19. The floor profile arrangement according to claim 1, wherein on the base profile two articulation channels are formed on different height levels for the articular cavity, a desired breakage seam is formed between the two articulation channels and the upper articulation channel is disposed on a base.

* * * * *